US006928755B2

(12) United States Patent
Chen et al.

(10) Patent No.: US 6,928,755 B2
(45) Date of Patent: Aug. 16, 2005

(54) SHOE HAVING A THREE-DIMENSIONAL INSOLE

(75) Inventors: Eddie Chen, 9F, No. 201, Sec. 1, Taichung Kang Rd., Taichung City (TW); Phoenix Hsu, Taichung (TW)

(73) Assignee: Eddie Chen, Taichung (TW)

( * ) Notice: Subject to any disclaimer, the term of this patent is extended or adjusted under 35 U.S.C. 154(b) by 30 days.

(21) Appl. No.: 10/678,237

(22) Filed: Oct. 3, 2003

(65) Prior Publication Data

US 2005/0072024 A1 Apr. 7, 2005

(51) Int. Cl.[7] ..... A43B 13/28; A43B 13/18

(52) U.S. Cl. ..... 36/12; 36/16; 36/17 R; 36/21

(58) Field of Search ..... 36/12, 16, 17 R, 36/22 R, 14, 21, 43

(56) References Cited

U.S. PATENT DOCUMENTS 401,060 A * 4/1889 Pillow ..... 36/88
1,216,358 A * 2/1917 Prenzel ..... 36/16
1,265,100 A * 5/1918 Madson ..... 36/16
1,273,292 A * 7/1918 Vescio ..... 36/17 R
1,458,719 A * 6/1923 McLeod ..... 36/91
1,756,169 A * 4/1930 Benda ..... 36/17 R
1,778,002 A * 10/1930 Richardson et al. ..... 36/181
1,957,424 A * 5/1934 Madson ..... 36/16
1,963,577 A * 6/1934 Cuozzo ..... 36/83
2,327,415 A * 8/1943 Forschner ..... 36/9 R
2,574,582 A * 11/1951 Rollman ..... 36/14
2,744,340 A * 5/1956 Gerber ..... 36/11.5
4,122,574 A * 10/1978 Karalis ..... 12/142 RS
4,505,055 A * 3/1985 Bergmans ..... 36/18
4,852,275 A * 8/1989 Bianchini et al. ..... 36/102
5,285,546 A * 2/1994 Haimerl ..... 12/142 E
6,560,899 B2 * 5/2003 Chen ..... 36/14

* cited by examiner

*Primary Examiner*—M. D. Patterson
(74) *Attorney, Agent, or Firm*—Ladas & Parry LLP

(57) ABSTRACT

A shoe comprises a three-dimensional insole including a base, and a wall part extending upward from an outer peripheral end of the base, each of the base and the wall part being made of a sheeting material. The wall part is sewn to the outer peripheral end of the base to form a three-dimensional outline. An upper has a bottom open end connected to the wall part of the insole, and an outsole is connected to the bottom open end of the upper and the three-dimensional insole.

17 Claims, 15 Drawing Sheets

SHOE HAVING A THREE-DIMENSIONAL INSOLE

BACKGROUND OF THE INVENTION

1. Field of the Invention

This invention relates to a shoe, more particularly to a shoe having a three-dimensional insole which provides an upper with a welt configuration.

2. Description of the Related Art

FIGS. 1 and 2 show a shoe which is configured to have an appearance of a welted shoe (i.e. the so-called San Crispino construction) as disclosed in U.S. Pat. No. 6,018,891. The shoe includes an upper 1 with a bottom open end 101, a molded foot cup 2 having a flanged part 201, and an outsole 3. The bottom open end 101 of the upper is folded about and encloses the flanged part 201 of the foot cup 2 and is sewn to the flanged part 201, thus forming a welt configuration. The outsole 3 is secured to the foot cup 2 and has a top peripheral end which is in abutment with the bottom open end 101 of the upper below the welt configuration.

In the aforesaid shoe, although the bottom open end 101 of the upper 1 is formed with a welt configuration by simply folding the upper 1 to enclose the flanged part 201 of the foot cup 2, the shoe suffers from the following drawbacks:

1. A special mold is needed to fabricate the foot cup 2, thus increasing the production cost.

2. Since the foot cup 2 is injection molded through a special mold, the material used for the foot cup 2 is limited to a thermoplastic rubber or an injection moldable plastic material. The foot cup cannot be made from other materials. In addition, because the foot cup 2 is molded, it can be made only from a single plastic material and cannot be produced from a combination of different materials.

3. As the foot cup 2 is injection molded through a special mold, the shape thereof is limited to the design of the mold so that the shape of the flanged part 201 cannot be varied to form a curve shape or a wavy curve that rises and falls alternately. In other words, the welt configuration formed at the bottom side of the upper 1 can extend only along a line lying in the same horizontal plane. It is impossible to modify the welt configuration to match different shoe designs.

SUMMARY OF THE INVENTION

An object of the present invention is to provide a shoe having a three-dimensional insole, which is inexpensive to manufacture and less limited by the material from which the insole is made and which exhibits good flexibility and permits the upper to be formed with various welt configurations.

According to this invention, a shoe comprises a three-dimensional insole including a base, and a wall part extending upward from an outer peripheral end of the base, each of the base and the wall part being made of a sheeting material, the wall part being sewn to the outer peripheral end of the base to form a three-dimensional outline; an upper having a top open end, and a bottom open end opposite to the top open end, the bottom open end being connected to the wall part; and an outsole connected to the bottom open end of the upper and the three-dimensional insole.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
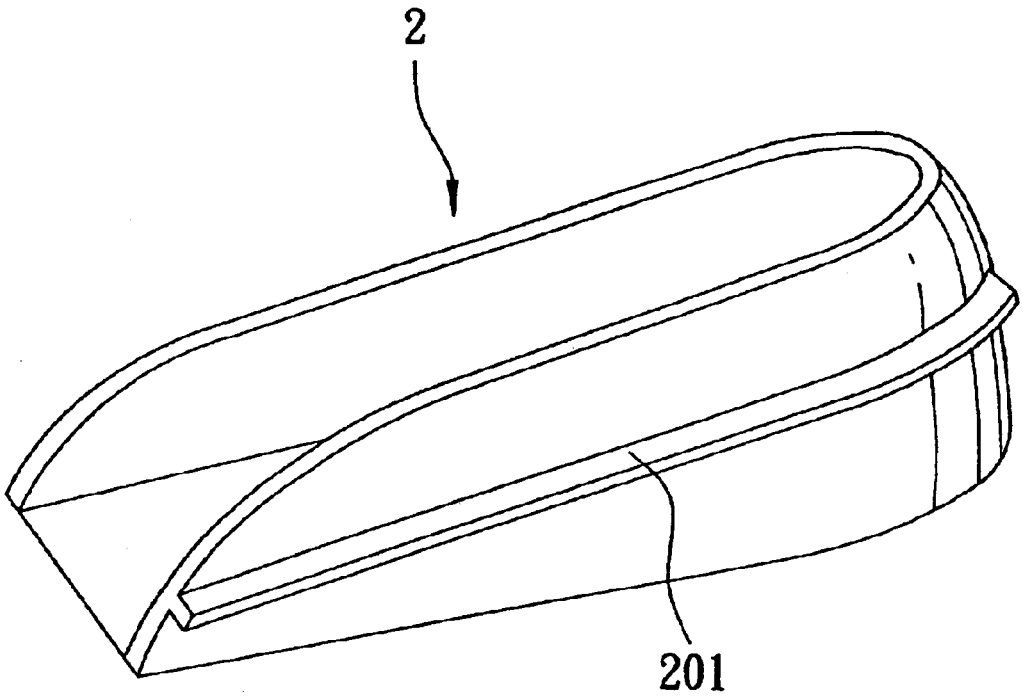
FIG. 1 PRIOR ART
FIG. 1 shows a conventional foot cup.
Figure 2:
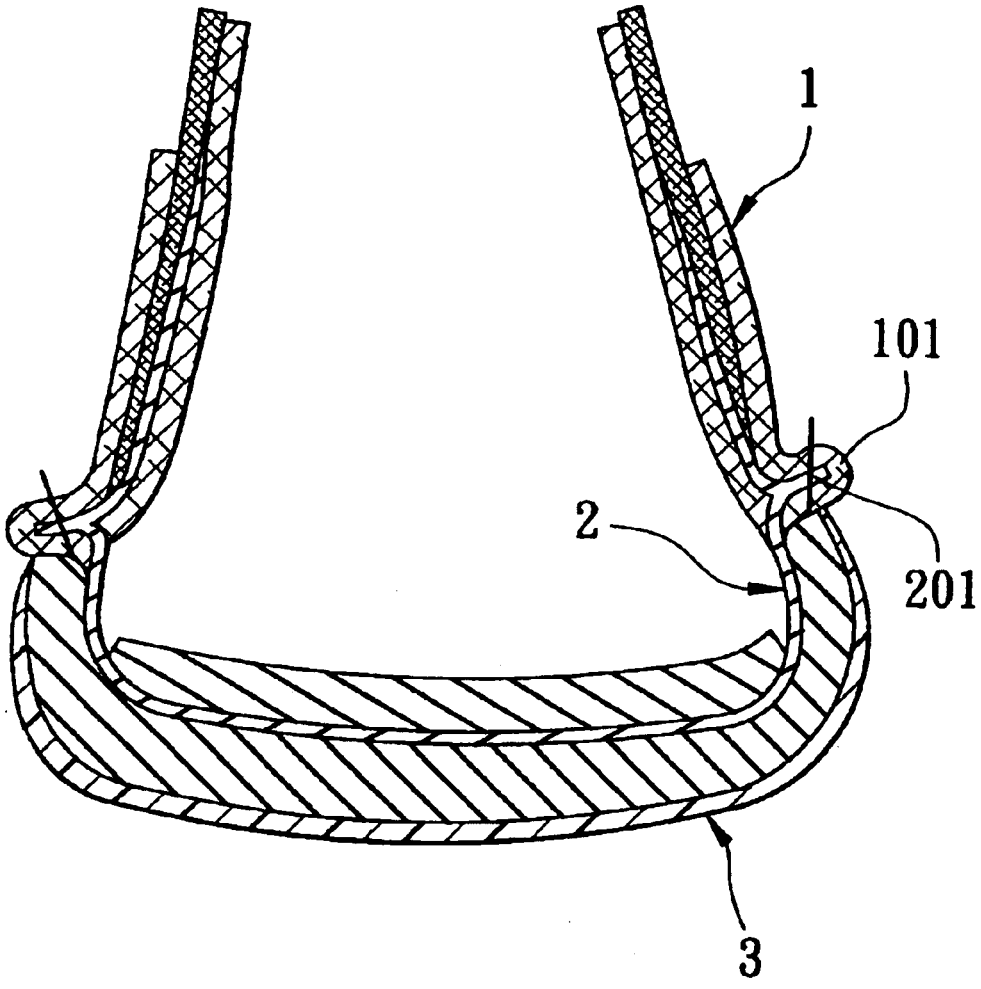
FIG. 2 PRIOR ART
FIG. 2 shows a conventional shoe construction having the conventional foot cup.

Before the present invention is described in greater detail, it should be noted that same reference numerals have been used to denote like elements throughout the specification.

Figure 3:
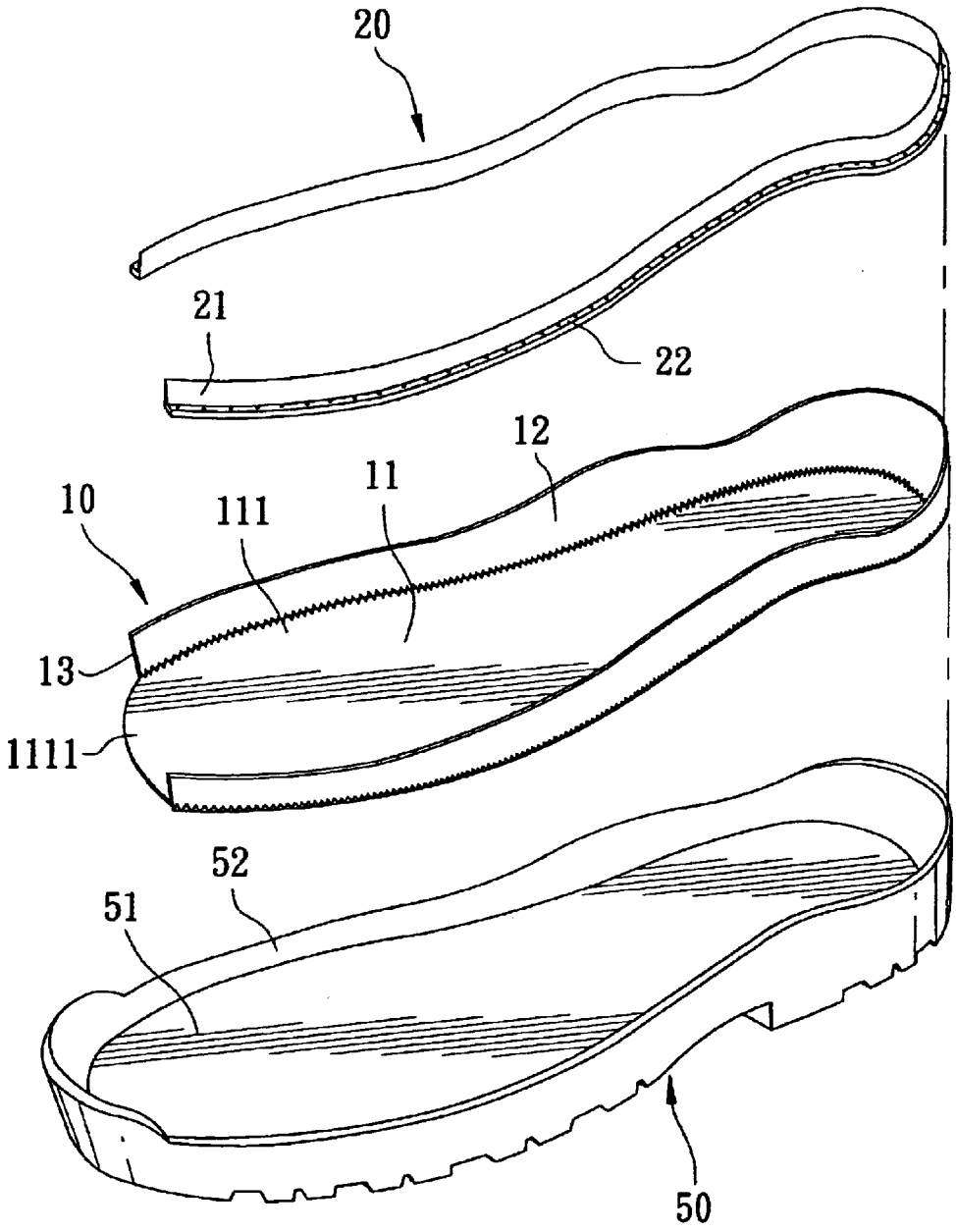
FIG. 3 is an exploded view showing components of a first embodiment of a shoe according to the present invention.
Figure 4:
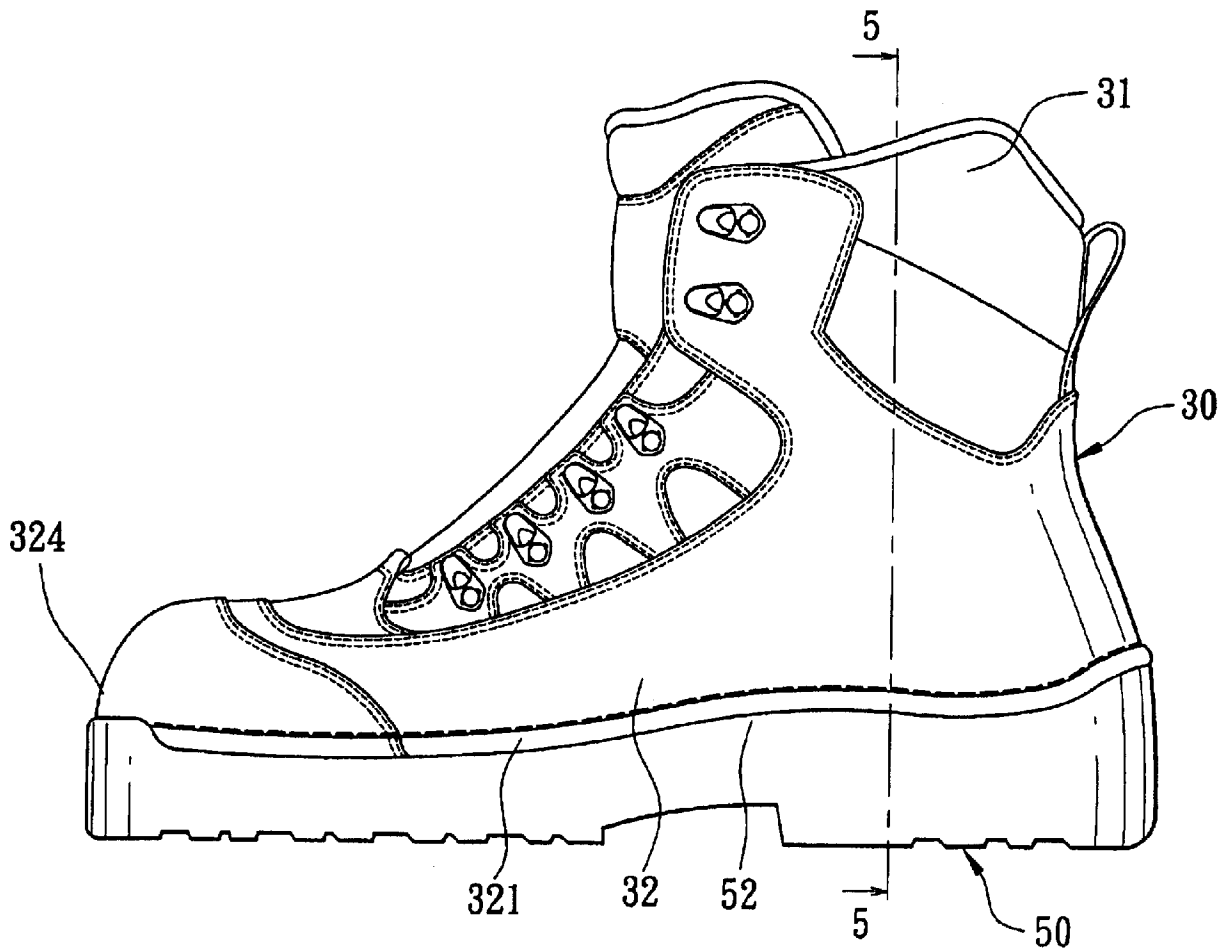
FIG. 4 is a side view showing the first embodiment of a shoe according to the present invention.
Figure 5:
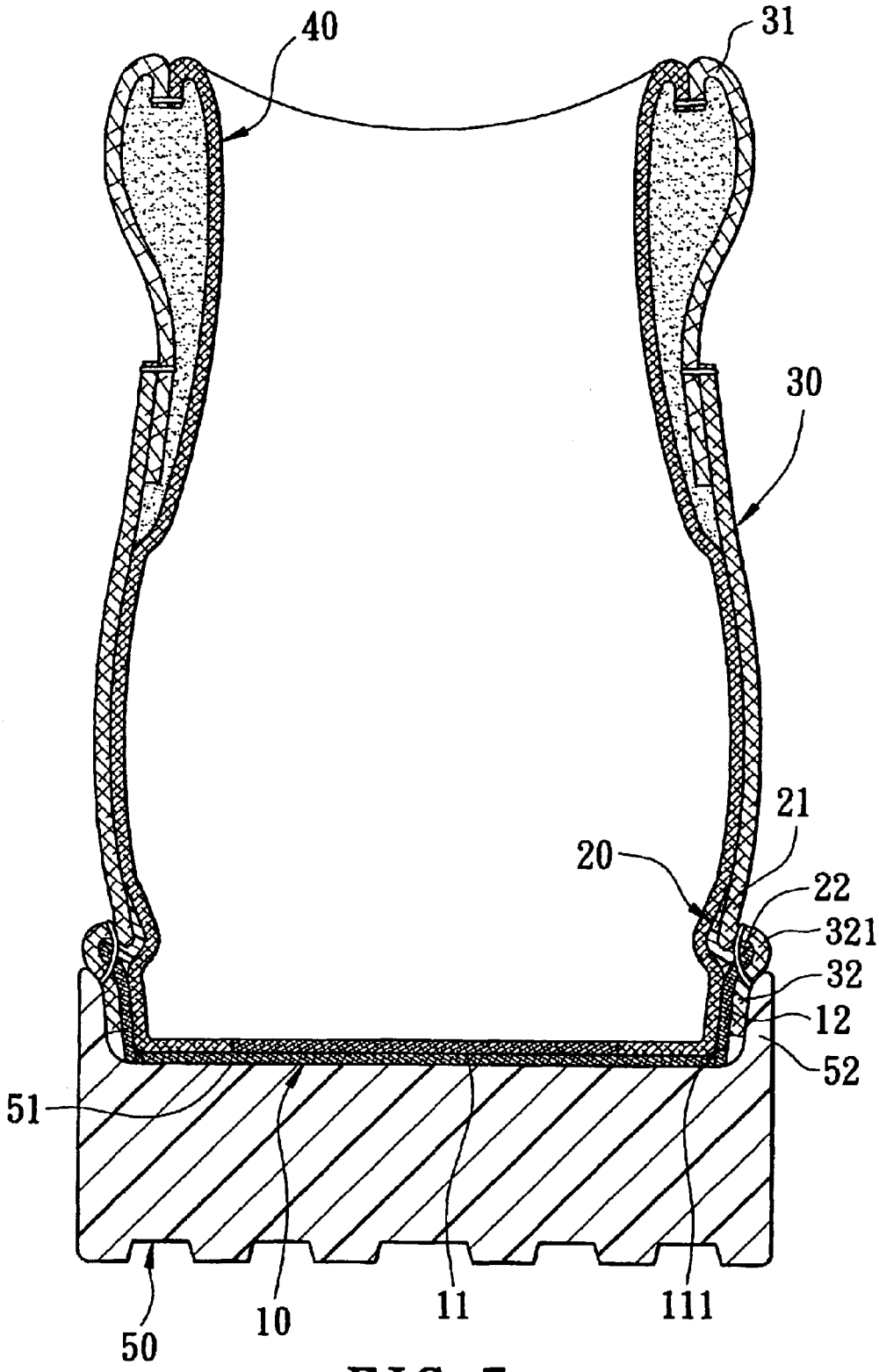
FIG. 5 is a sectional view taken along lines 5—5 of FIG. 4.

Referring to FIGS. 3, 4 and 5, a first preferred embodiment of the shoe according to the present invention is shown to comprise a three-dimensional insole 10, a welt unit 20, an upper 30, an inner lining unit 40 and an outsole 50.

The three-dimensional insole 10 has a sheet-like base 11 and a sheet-like wall part 12 both of which are made of a sheeting material. The base 11 has an outer peripheral end 111 with a frontmost edge 1111. The wall part 12 is in the form of a longitudinal strip which extends from the frontmost edge 1111 to a rear end of the base 11 along the outer peripheral end 111. The wall part 12 is sewn to the outer peripheral end 111 and extends upward from the outer peripheral end 111. A cutout part 13 is defined above the frontmost edge 1111 by two longitudinally opposed ends of the wall part 12. A three-dimensional outline is therefore formed by the wall part 12 and the base 11.

In this embodiment, the base 11 is made of a sheeting material such as a fabric, and the wall part 12 is made of the same fabric as the base 11. Of course, the base 11 and the wall part 12 may be made from different fabric materials. If necessary, the base 11 may include a front half and a rear half which are sewn to each other and which are made of different fabric materials. For example, the front half of the base 11 may be made of a soft material to provide good flexibility, whereas the rear half of the base 11 may be made of a high stiffness material to provide a supporting property. Likewise, the wall part 12 may be provided with front and rear parts which are made of different materials and which are sewn together.

The welt member 20 is formed as a strip having an L-shaped cross-section and includes an upward projection part 21 and an outward protrusion part 22 protruding from a bottom end of the upward projection part 21. The outward protrusion part 22 extends along full length of the wall part 12 and is cemented to the top of the wall part 12.

The upper 30 has a top open end 31 and a bottom open end 32 which has a folded part 321 and a toe end 324. The folded part 321 extends along full length of the welt member 20 and is folded to enclose the outward protrusion part 22 of the welt member 20 and the wall part 12. Moreover, the folded part 321 is sewn to the outward protrusion part 22 and the wall part 12, forming a welt configuration which is curved upward and downward along the profile of the top end of the wall part 12. The toe end 324 of the upper 30 has a bottom end cemented to the bottom side of the base 11.

Although the welt member 20 is provided in this embodiment, the welt member 20 is not an indispensable element. The welt member 20 may or may not be provided according to the present invention. When the welt member 20 is omitted, the folded part 321 which extends full length of the wall part 12 will enclose only the wall part 12. The welt configuration resulting from this construction may curve upward and downward along the profile of the wall part 12.

The inner lining 40 has a top open end sewn to the top open end 31 of the upper 30. In the embodiment, the inner lining 40 is configured as a sock-like lining.

The outsole 50 has a top face 51 and a peripheral wall 52 extending around the top face 51. When the outsole 50 is attached to the bottom open end 32 of the upper 30 and the base 11 of the insloe 10, the base 11 of the insole 10 is placed within the outsole 50 at a level lower than the top end of the peripheral wall 52, and the folded part 321 of the upper 30 is higher than the top end of the peripheral wall 52.

The aforesaid construction according to the present invention provides the following advantages:

1. Since the base 11 and the wall part 12 of the three-dimensional insole 10 are tailored from a sheeting material such as a fabric, and since the base 11 and the wall part 12 are interconnected through a sewing process to form a three-dimensional insole 10, the insole 10 can be produced easily without using a special mold, thereby lowering the production cost as compared with the molded foot cup 2 used in the prior art which requires a special mold.

2. As the three-dimensional insole 10 is formed by tailoring and by sewing the base 11 and the wall part 12, rather than by injection molding a plastic material within a special mold, the base 11 and the wall part 12 are less limited by materials as compared with the foot cup 2 of the prior art. Moreover, the base 11 may be made from a single sheeting material or from a combination of different sheeting materials as desired. Use of a combination of materials in the base 11 can provide different physical properties required by different parts of the base 11. Furthermore, the base 11 and the wall part 12 may be made by using the same material or different materials.

3. As the three-dimensional insole 10 is made from a sheeting material, the shoe according to the present invention not only has light weight but also exhibits good flexibility.

4. Because the wall part 12 is tailored from a sheeting material and is sewn to the base 10, the wall part 12 may be designed variably to match different shoe configurations. For example, the wall part 12 may be provided with a varying height or profile through a tailoring process. After the folded part 321 of the upper 30, which extends along full length of the wall part 12, is folded to enclose the wall part 12 of varying height and is sewn thereto, it will provide a welt configuration, after modifying the mold, which is curved upward and downward alternately along the top end of the wall part 12. Therefore, compared with the conventional foot cup 2, whose shape is limited by the design of the mold and which does not permit variation of the welt configuration, the insole 10 according to the present invention is advantageous in that it provides a variety of welt configurations by using simple processes.

5. The wall part 12 according to the present invention may be sewn continuously to the base 11 to form a looped configuration. As such, the folded part 321 is formed into a loop-shaped welt configuration without the need to use a new mold for changing the shape of the insole 10. It is unnecessary to utilize different molds to form the insole 10 of the present invention into various shapes, unlike the foot cup disclosed in U.S. Pat. No. 6,018,891 which requires a new mold when the shape thereof is to be changed.

Figure 6:
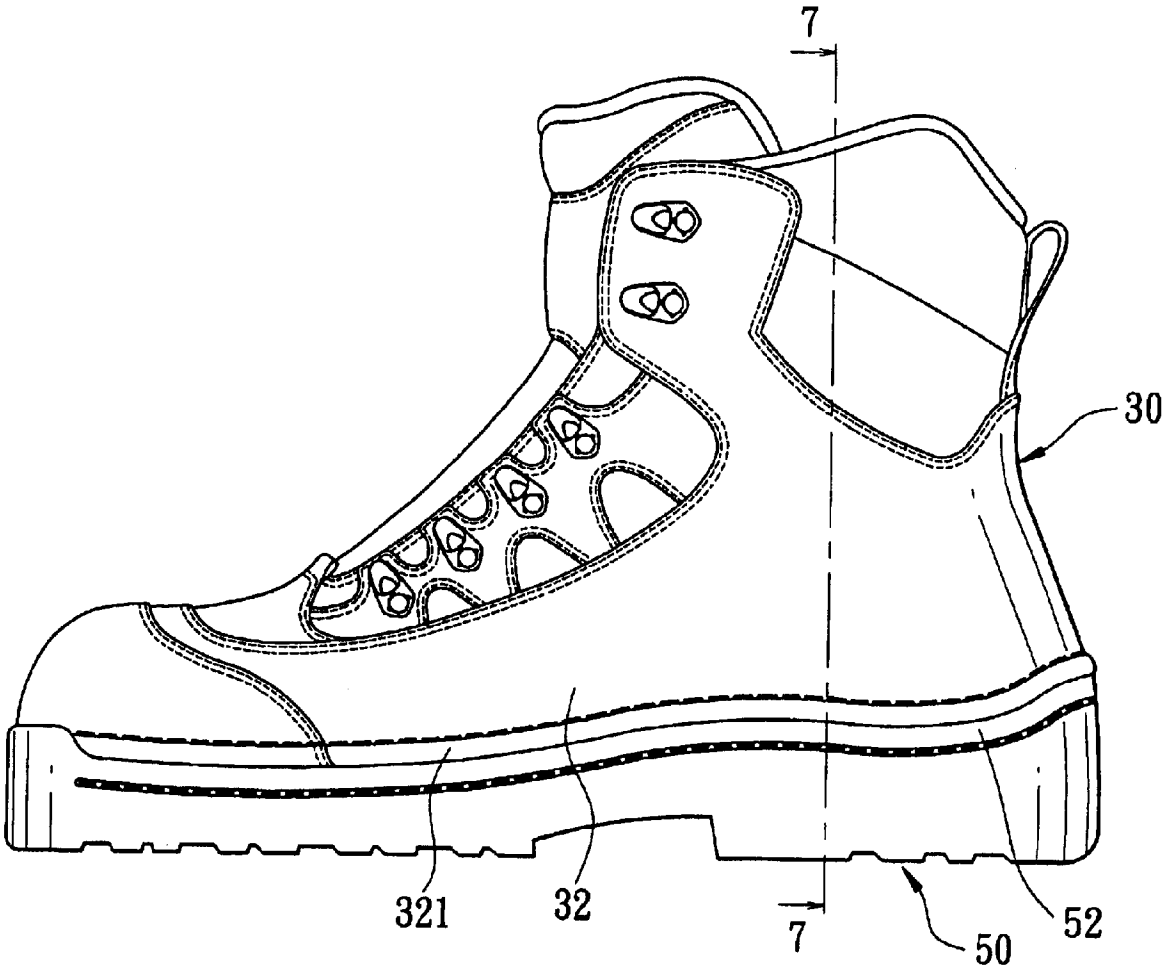
FIG. 6 is a side view showing a second embodiment of the present invention.
Figure 7:
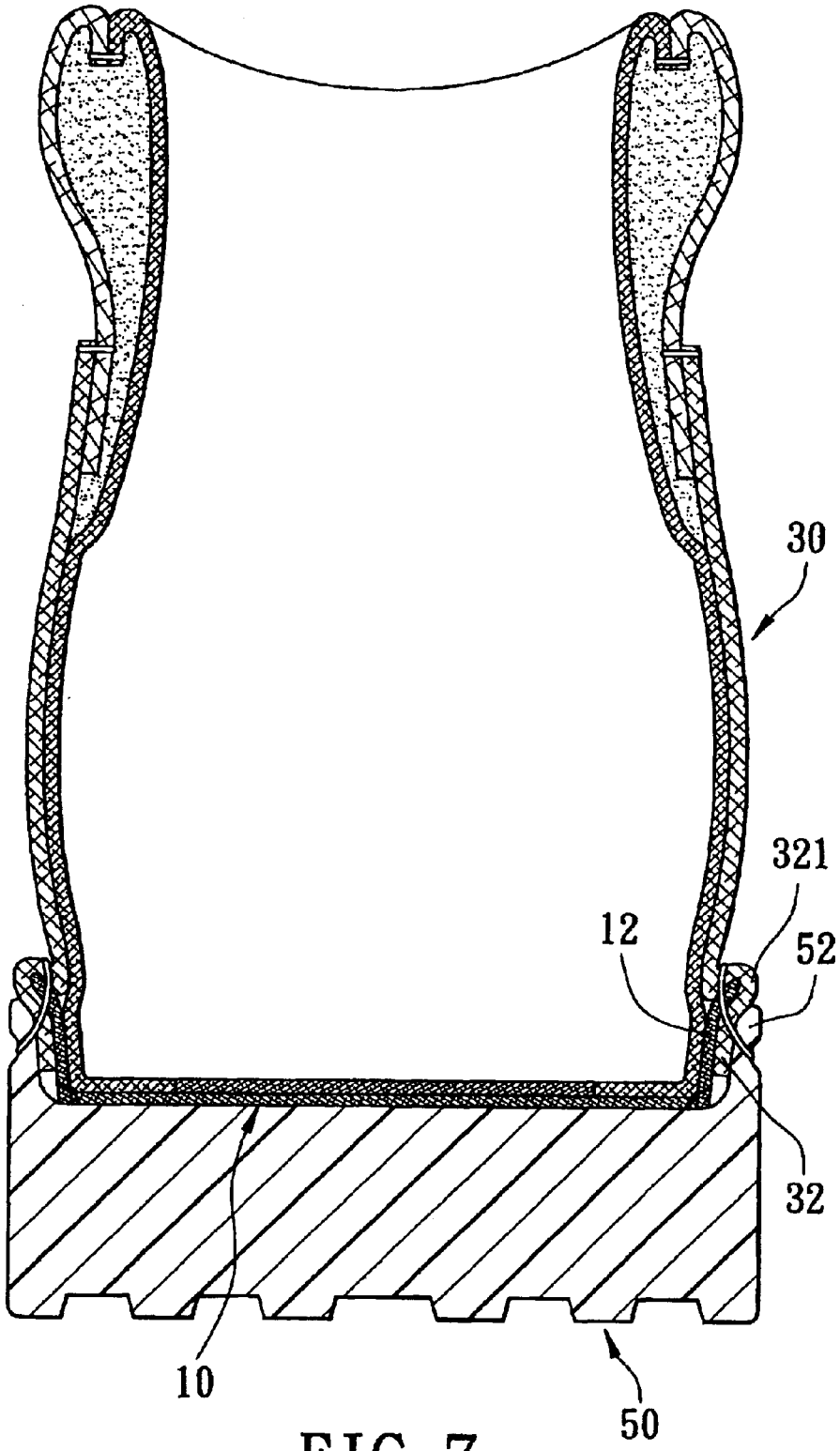
FIG. 7 is sectional view taken along lines 7—7 of FIG. 6.

FIGS. 6 and 7 show a second embodiment of the present invention which differs from the first embodiment in that the welt member 20 used in the first embodiment is eliminated in the second embodiment and that the folded part 321 of the bottom open end 32 of the upper 30 extends along the wall part 12 and is folded about a top end of the wall part 12 so that the folded part 321 encloses the top end of the wall part 12. Moreover, the folded part 321 is sewn to the top end of the wall part 12 and the top end of the peripheral wall 52 of the outsole 50. Apart from achieving the objectives and results of the first embodiment, the second embodiment enhances the connection between the upper 30 and the outsole 50 due to the sewing of the outsole 50 to the folded part 321.

Figure 8:
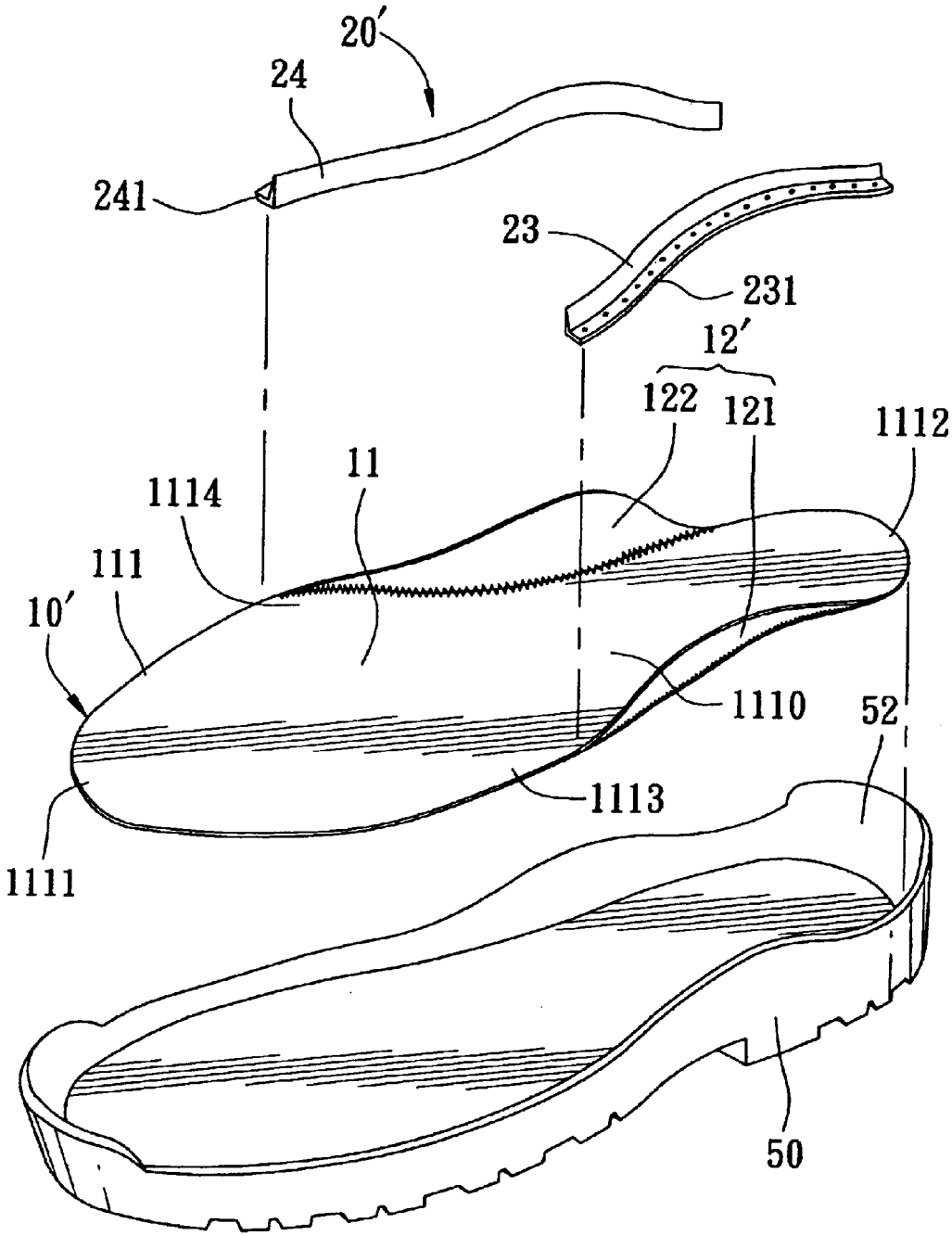
FIG. 8 is an exploded view showing a third embodiment of a shoe according to the present invention.
Figure 9:
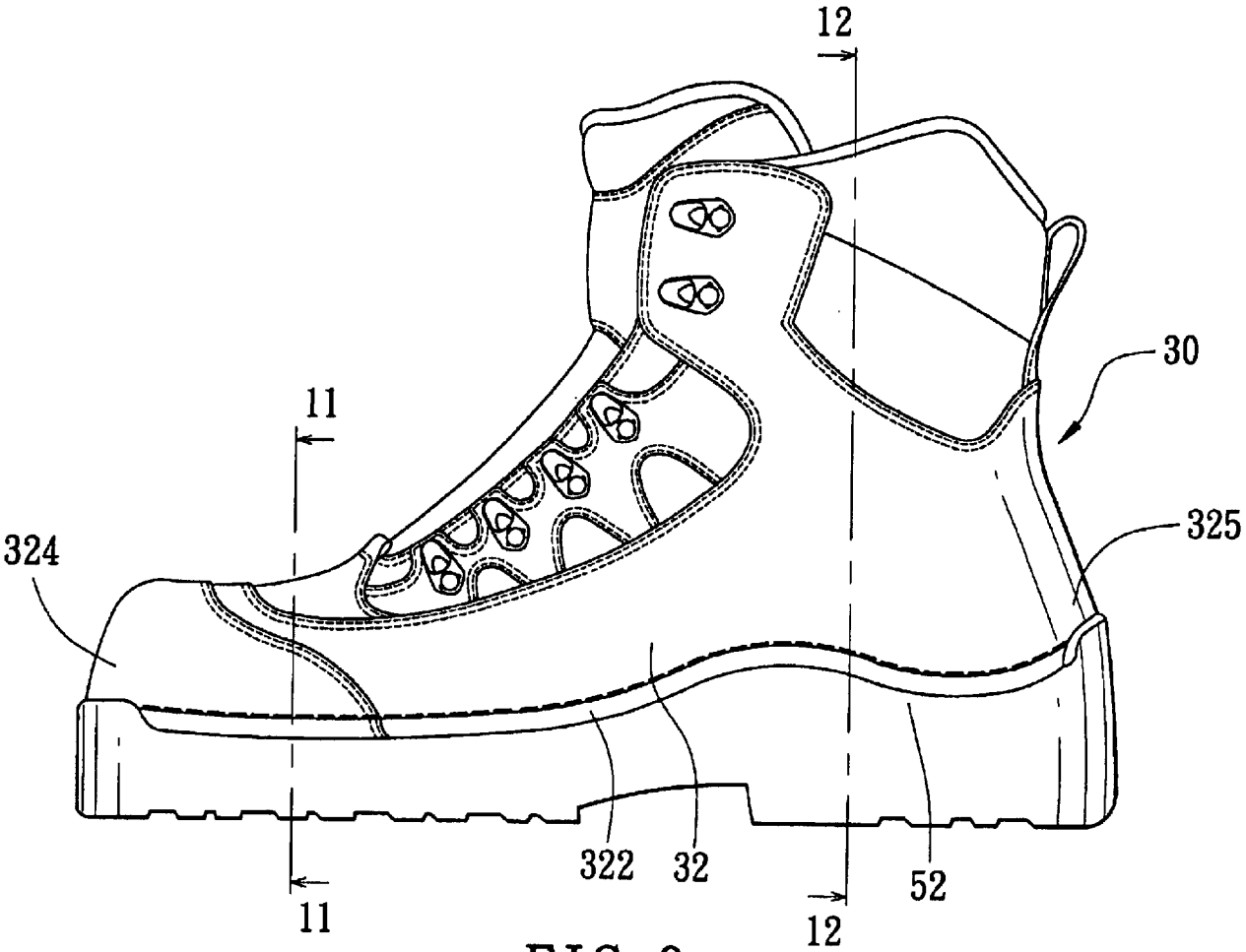
FIG. 9 is a side view of the third embodiment viewed from the outer side of the shoe.
Figure 10:
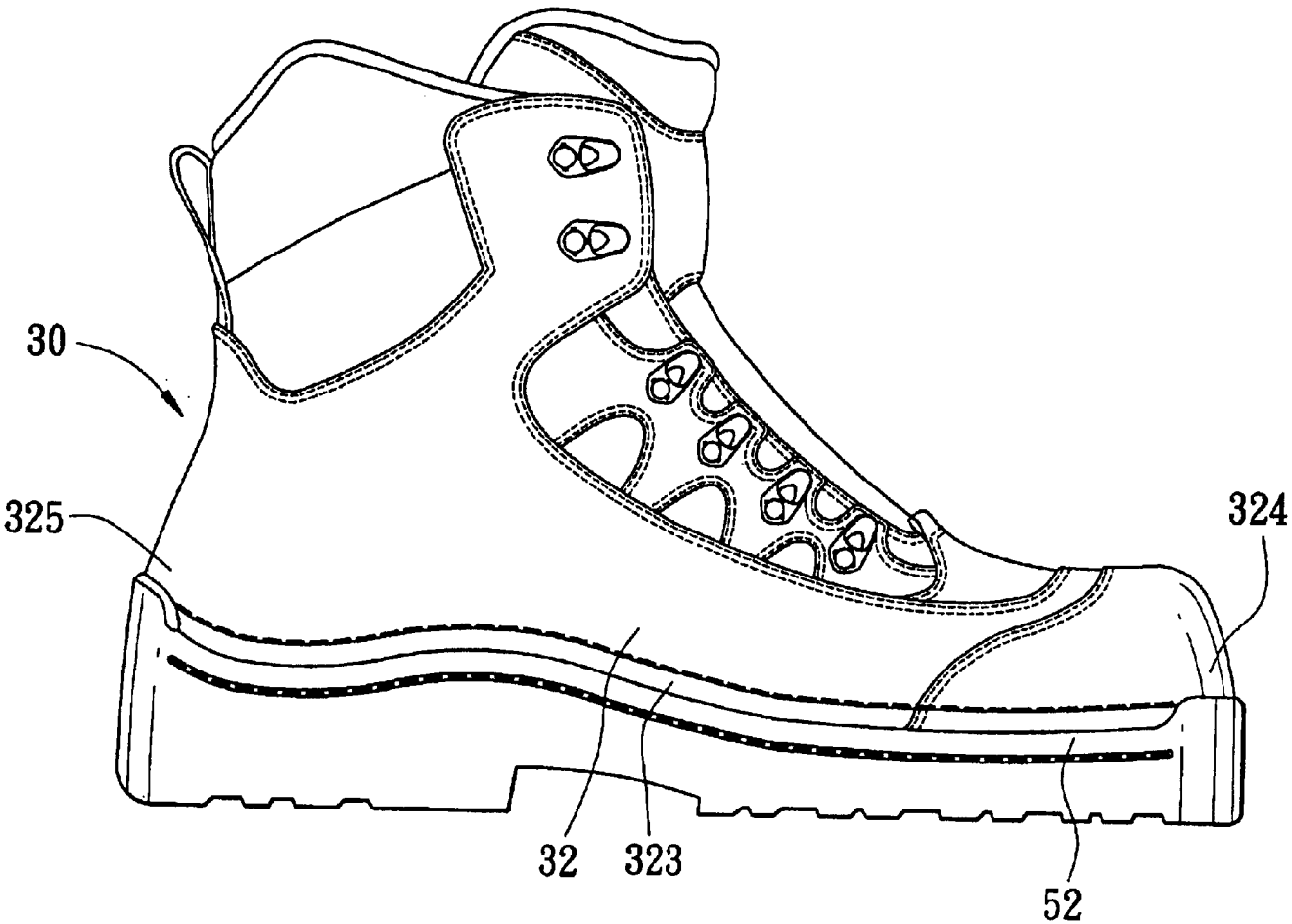
FIG. 10 is a side view of the third embodiment viewed from the inner side of the shoe.

Referring to FIGS. 8, 9 and 10, a third embodiment according to the present invention is substantially similar to the first embodiment except for the features described as follows: In place of the single piece welt member 20 of the first embodiment, the third embodiment employs a welt unit 20' which includes an inner welt strip 23 and an outer welt strip 24. The insole 10' in this embodiment includes a base 11 with an outer peripheral end 111 which includes a frontmost edge 1111, a rearmost edge 1112, an inner edge 1113, and an outer edge 1114 opposite to the inner edge 1113. Both of the inner and outer edges 1113, 1114 extend between the frontmost and rearmost edges 1111, 1112.

The wall part 12' of the insole 10' includes an inner shank plate 121 and an outer shank plate 122. The inner and outer shank plates 121, 122 are sewn respectively to the inner and outer edges 1113 and 1114 in an intermediate shank region 1110 of the base 11. The inner welt strip 23 has an outward protrusion part 231 which is cemented to the top end of the inner shank plate 121 along the top end of the inner shank plate 121 (see FIG. 12). The outer welt strip 24 has an outward protrusion part 241 which is cemented to the top end of the outer shank plate 122 along the top end of the outer welt strip 24 (see FIG. 12).

Figure 11:
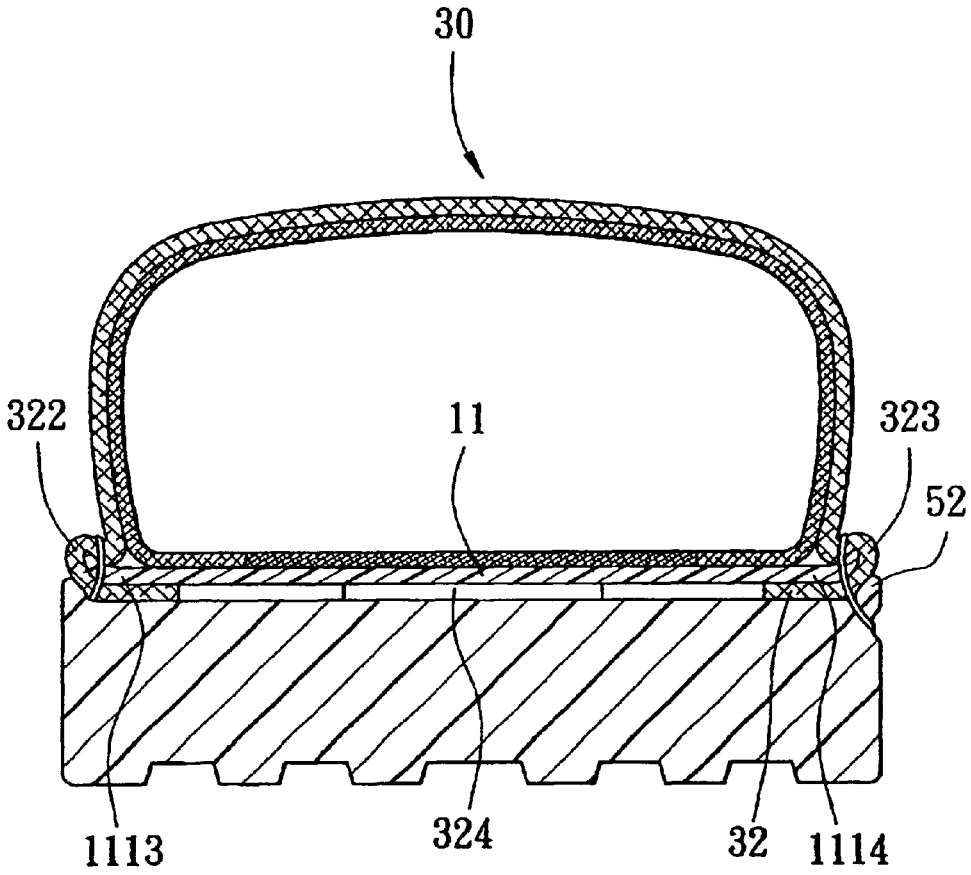
FIG. 11 is a sectional view taken along line 11—11 of FIG. 9.
Figure 12:
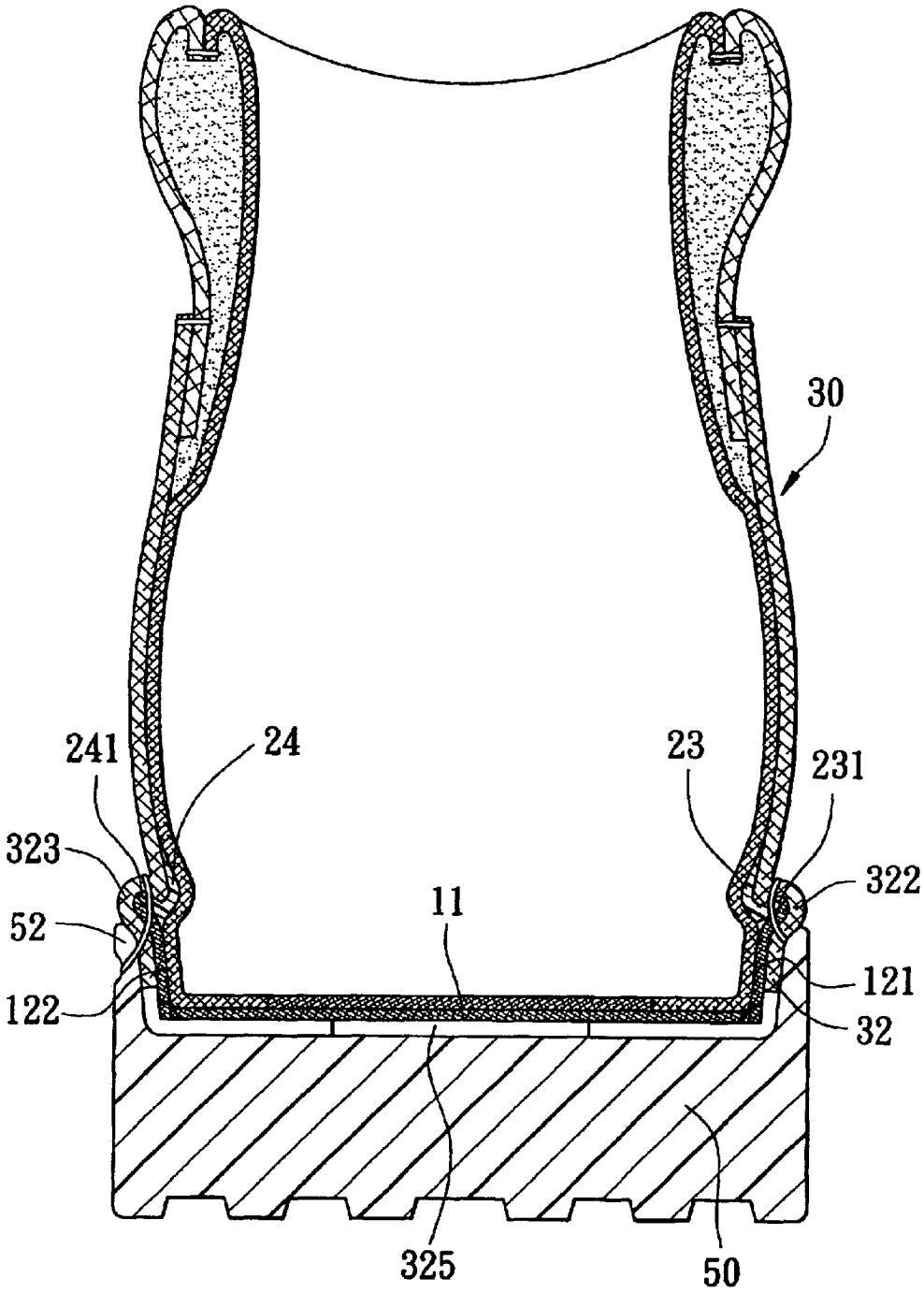
FIG. 12 is a sectional view taken along line 12—12 of FIG. 9.

Referring to FIGS. 11 and 12 in combination with FIGS. 9 and 10, the bottom open end 32 of the upper 30 has an inner fold section 322, an outer fold section 323, a toe end 324 and a heel end 325. Each of the toe and heel ends 324, 325 extends between the inner and outer fold sections 322 and 323. The inner fold section 322 extends along the inner shank plate 121 and the inner edge 1113 on two sides of the inner shank plate 121. The outer fold section 323 extends along the outer shank plate 122 and the outer edge 1114 on two sides of the outer shank plate 122.

The inner fold section 322 is folded about and sewn to the inner edge 1113 on two sides of the inner shank plate 121, the outward protrusion part 231 of the inner welt strip 23, and the inner shank plate 121, thus enclosing the inner edge 1113, the inner shank plate 121 and the outward protrusion part 231 of the inner welt strip 23. The outer fold section 323 is folded about and encloses the outer shank plate 122, the outer edge 1114 on two sides of the outer shank plate 122, and the outward protrusion part 241 of the outer welt strip 24, and is sewn to the outer shank plate 122, the outer edge 1114, the outward protrusion part 241 of the outer welt strip 24, and a portion of the peripheral wall 52 of the outsole 50 adjacent to the outer edge 1114. The bottom ends of the toe and heel ends 324, 325 of the upper 30 are cemented to the bottom of the base 11. In case, the insole 10' has, in addition to the inner and outer shank plates 121, 122, front and rear plates (not shown) which extend upward respectively at the frontmost and rearmost edges 1111 and 1112 of the base 11, the bottom sides of the toe and heel ends 324 and 325 of the upper 30 may be cemented to the front and rear plates (not shown). Alternatively, the process of cementing the bottom open end of the upper 30 to the insole 10' may be dispensed with in the third embodiment.

Apart from achieving the objective and effect accomplished by the first embodiment, the third embodiment provides a different outer appearance (see FIGS. 9 and 10). Of course, this embodiment may be altered by not sewing the outer fold section 323 to the peripheral wall 52 while the inner fold section 322 is sewn to the peripheral wall 52, or by not sewing both of the inner and outer fold sections 322, 323 to the outer peripheral wall 52. In addition, the welt member 20' may be dispensed with according to the present invention.

As described above, the shoe having a three-dimensional insole according to the present invention not only can be produced at low cost, but also provides good flexibility. Moreover, the shoe is less limited by the material of the insole 10, 10', and the welt configuration may be varied as desired.

Figure 13:
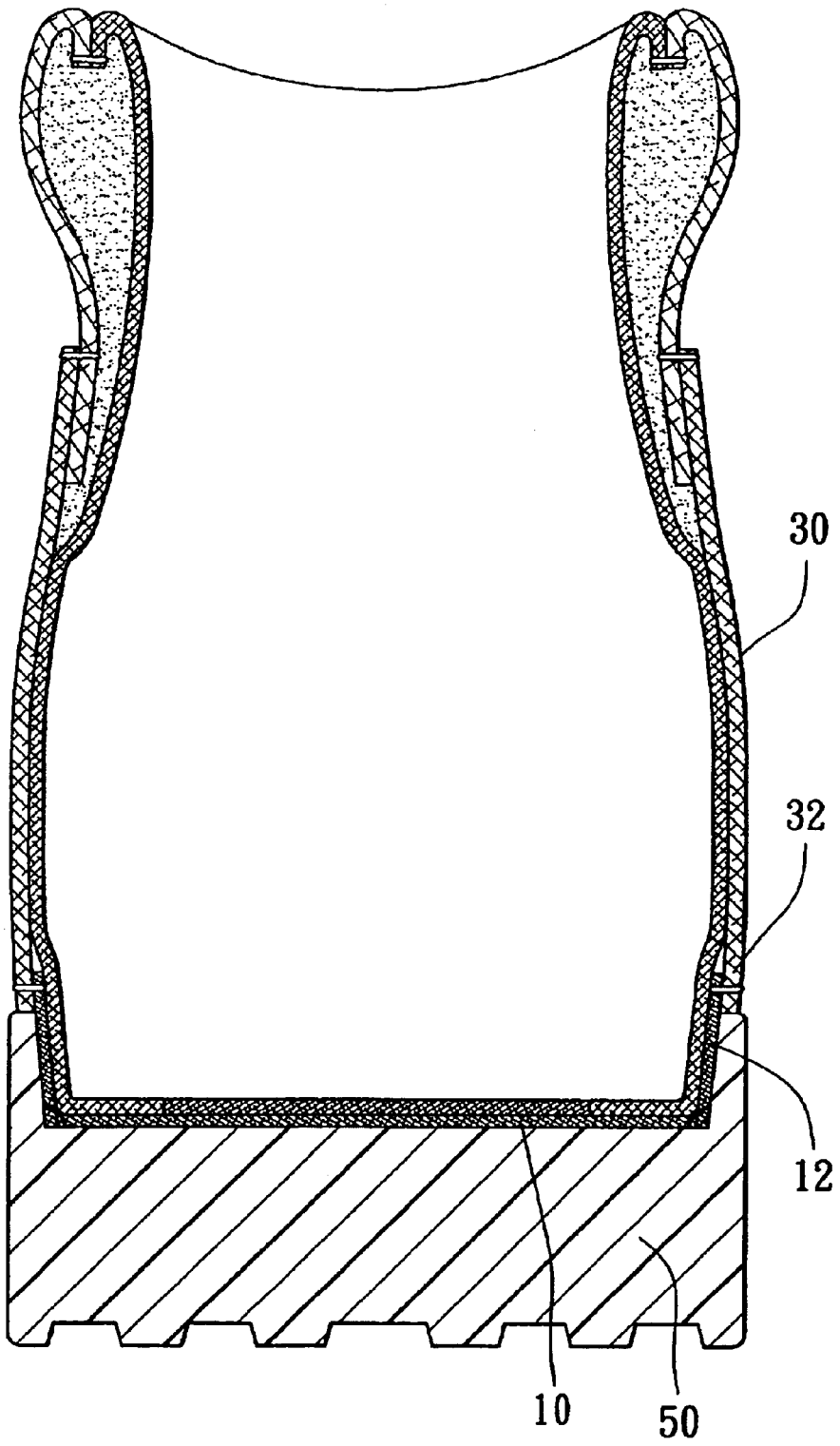
FIG. 13 is a sectional view showing a fourth embodiment of a shoe according to the present invention.

Referring to FIG. 13, a fourth embodiment of the present invention is substantially similar to the first embodiment except that the bottom open end 32 of the upper 30 extends along the wall part 12 of the insole 10 without being folded and is sewn only to the top end of the wall part 12. This embodiment has not welt unit. The amount of the material used in this construction is less as compared to a cement construction and a strobel stitching construction.

Figure 14:
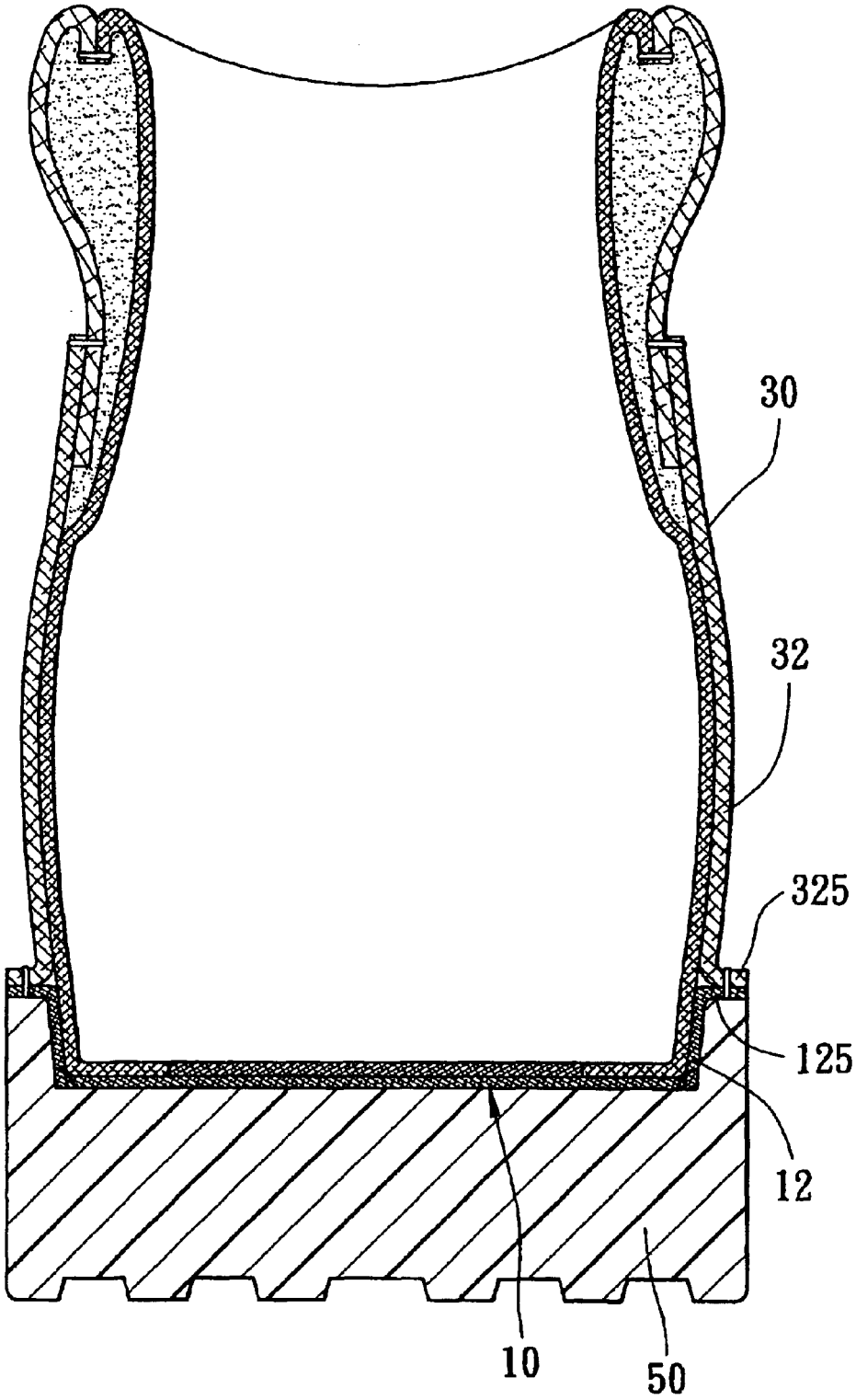
FIG. 14 is a sectional view showing a fifth embodiment of a shoe according to the present invention.

Referring to FIG. 14, in a fifth embodiment of the present invention, the bottom open end 32 of the upper 30 has an outwardly turned bottom edge 325, and the wall part 12 of the insole 10 has an outwardly turned top edge 125 sewn to the outwardly turned bottom edge 325.

Figure 15:
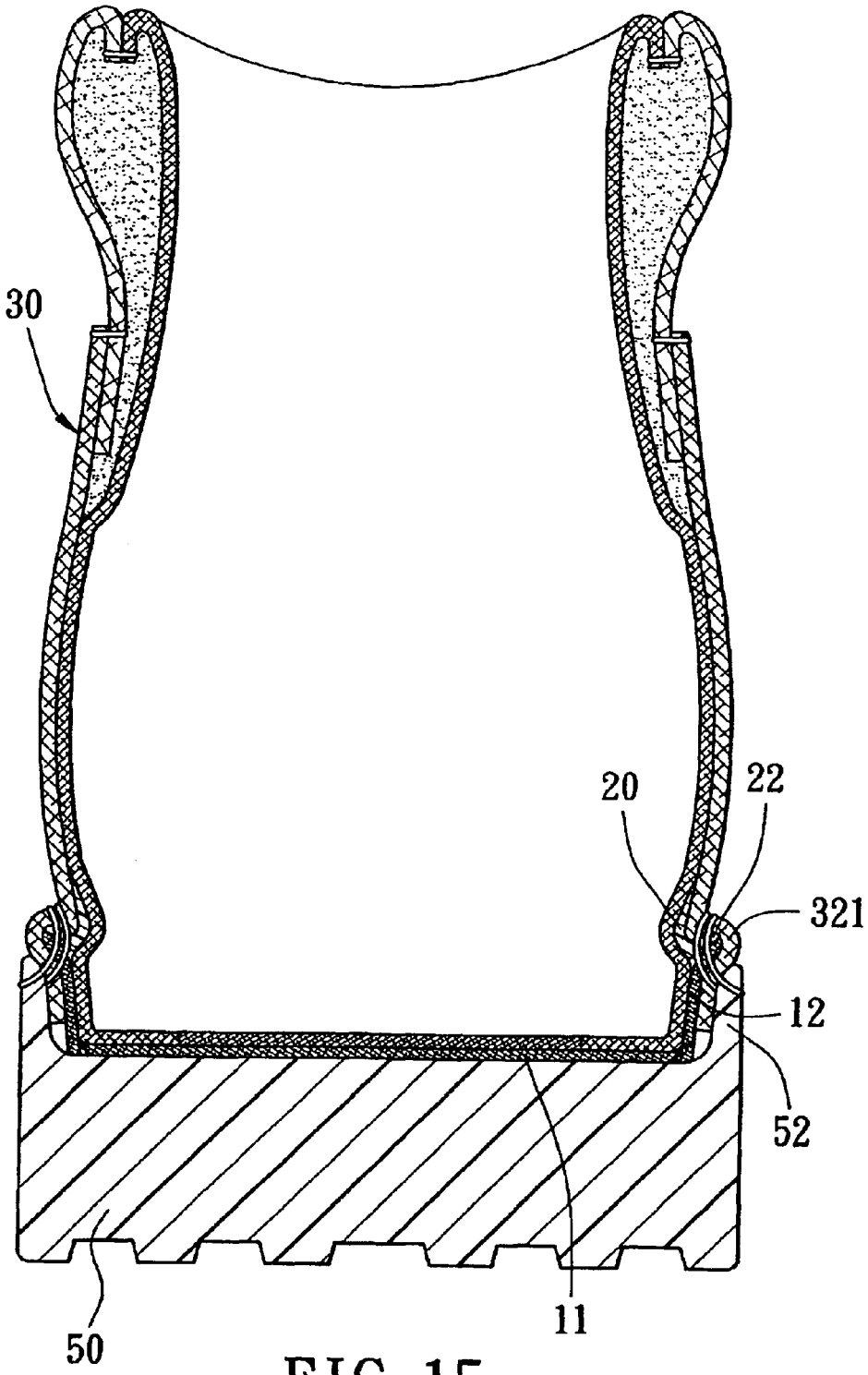
FIG. 15 is a sectional view showing a sixth embodiment of the present invention.

FIG. 15 shows a sixth embodiment which is substantially similar to the third embodiment in that the folded part 321 is sewn to not only the outward protrusion part 22 of the welt member 20 and the wall part 12 of the insole 10, but also the outsole 50 and that the folded part 321 is sewn by means of two stitch lines.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

We claim:

1. A shoe comprising:

a three-dimensional insole including a base, and a wall part extending upward from an outer peripheral end of said base, each of said base and said wall part being made of a sheeting material, said wall part being attached to said outer peripheral end of said base to form a three-dimensional outline, said outer peripheral end of said base includes a frontmost edge, a rearmost edge, and inner and outer edges interconnecting said frontmost and rearmost edges, said wall part extending along said inner and outer edges, said base having an intermediate shank region between said frontmost and rearmost edges, said wall part including inner and outer shank plates attached respectively to said inner and outer edges in said intermediate shank region;

an upper having a top open end, and a bottom open end opposite to said top open end, said bottom open end having at least one folded part which is folded about said wall part and said outer peripheral end of said base so as to enclose said wall part and said outer peripheral end and which is secured to said wall part and said outer peripheral end; and an outsole connected to said bottom open end of said upper and said three-dimensional insole.

2. The shoe as claimed in claimed in claim 1, wherein said outsole includes a top face and a peripheral wall surrounding said top face.

3. The shoe as claimed in claim 1, wherein said folded part includes an inner fold section and an outer fold section, said inner fold section extending along said inner shank plate and said inner edge on two sides of said inner shank plate, said inner fold section being folded to enclose said inner shank plate and said inner edge, said outer fold section extending along said outer shank plate and said outer edge on two sides of said outer shank plate, said outer fold section being folded to enclose said outer shank plate and said outer edge.

4. The shoe as claimed in claim 3, wherein said inner fold section is sewn to said inner shank plate and said inner edge, said outer fold section being sewn to said outer shank plate and said outer edge.

5. The shoe as claimed in claim 3, wherein said outsole includes a top face and a peripheral wall surrounding said top face, said inner fold section being sewn to said inner shank plate, said inner edge, and said peripheral wall of said outsole, said outer fold section being sewn to said outer shank plate and said outer edge.

6. The shoe as claimed in claim 3, wherein said outsole includes a top face and a peripheral wall surrounding said top face, said inner fold section being sewn to said inner shank plate, said inner edge, and said peripheral wall of said outsole, said outer fold section being sewn to said outer shank plate, said outer edge, and said peripheral wall of said outsole.

7. The shoe as claimed in claim 3, further comprising a welt member which includes an inner welt strip and an outer welt strip, said inner and outer welt strips being secured respectively to said inner and outer shank plates, said folded part including an inner fold section and an outer fold section, said inner fold section being folded to enclose said inner shank plate, said inner welt strip, and said inner edges, said outer fold section being folded to enclose said outer shank plate, said outer welt strip and said outer edge.

8. The shoe as claimed in claim 1, wherein said base is composed of a front half and a rear half, said front and rear halves being made of different sheeting materials.

9. The shoe as claimed in claim 1, wherein said base and said wall part of said insole are made of different sheeting materials.

10. The shoe as claimed in claim 1, wherein said base and said wall part of said insole are made of the same sheeting material.

11. The shoe as claimed in claim 1, wherein said bottom open end of said upper has an outwardly turned bottom edge, said wall part of said insole having an outwardly turned top edge, said outwardly turned bottom and top edges being sewn to each other.

12. A shoe comprising:

a three-dimensional insole including a base, and a wall part extending upward from an outer peripheral end of said base, each of said base and said wall part being made of a sheeting material, said wall part being attached to said outer peripheral end of said base to form a three-dimensional outline;

a welt member which is secured to and extends along said wall part;

an upper having a top open end, and a bottom open end opposite to said top open end, said bottom open end having at least one folded part which is folded about said wall part to enclose said wall part and said welt member and which is secured to said wall part;

an outsole connected to said bottom open end of said upper and said three-dimensional insole.

13. The shoe as claimed in claim 12, wherein said folded part is sewn to said wall part and said welt member.

14. The shoe as claimed in claim 12, wherein said welt member includes an upward projection part and an outward protrusion part which cooperatively define an L-shaped cross-section, said outward protrusion part being secured to said wall part.

15. The shoe as claimed in claim 12, wherein said outsole includes a top face and a peripheral wall surrounding said top face, said outsole being secured to said bottom open end of said upper, said base of said insole being lower than a top end of said peripheral wall.

16. The shoe as claimed in claim 12, wherein said outsole includes a top face and a peripheral wall surrounding said top face, said outsole being secured to said bottom open end of said upper, said folded part being higher than a top end of said peripheral wall.

17. The shoe as claimed in claim 12, wherein said outer peripheral end of said base has a front edge, said wall part extending along and being secured to said outer peripheral end of said base rearwardly of said front edge, said wall part having two longitudinally opposed ends on two sides of said front edge to define a cutout part above said front edge, said folded part extending along said wall part and being folded about said wall part so as to enclose said wall part, said folded part being sewn to said wall part.

* * * * *